US006186049B1

(12) United States Patent
Stoll et al.

(10) Patent No.: US 6,186,049 B1
(45) Date of Patent: Feb. 13, 2001

(54) LINEAR DRIVE MECHANISM WITHOUT A PISTON ROD

(75) Inventors: Kurt Stoll, Esslingen; Eric Angué, Stuttgart, both of (DE)

(73) Assignee: Festo AG & Co., Esslingen (DE)

( * ) Notice: Under 35 U.S.C. 154(b), the term of this patent shall be extended for 0 days.

(21) Appl. No.: 09/194,191

(22) PCT Filed: Feb. 13, 1998

(86) PCT No.: PCT/EP98/00839

§ 371 Date: Nov. 23, 1998

§ 102(e) Date: Nov. 23, 1998

(87) PCT Pub. No.: WO98/46889

PCT Pub. Date: Oct. 22, 1998

(30) Foreign Application Priority Data

Apr. 11, 1997 (DE) ..... 297 06 493 U

(51) Int. Cl.[7] ..... F01B 29/08
(52) U.S. Cl. ..... 92/88
(58) Field of Search ..... 92/88

(56) References Cited

U.S. PATENT DOCUMENTS 4,664,020 * 5/1987 Kaiser ..... 92/88
5,330,272 * 7/1994 Stoll ..... 92/88
5,555,789 9/1996 Rosengreen et al. .
5,701,798 12/1997 Noda ..... 92/88

FOREIGN PATENT DOCUMENTS 804 632 4/1951 (DE) .
0 370 157 A1 11/1988 (EP) .
0 540 015 A2 10/1992 (EP) .
WO 92/17321 10/1992 (WO) .

* cited by examiner

*Primary Examiner*—F. Daniel Lopez
(74) *Attorney, Agent, or Firm*—Hoffman & Baron, LLP

(57) ABSTRACT

A rod-less linear drive whose housing (2) delimits an interior space (4), in which a drive part (5) is located. The housing (2) is provided with a slot-like longitudinal opening (24), which on either side is flanked by a housing limb (25 and 26). An entraining part (35) connected with the drive part (5) projects through the longitudinal opening (24) to the outside, where it is kinematically coupled with a slide (36). The slide is supported by means of a guide means (41) on the housing (2), one of the two housing limbs (26) being extended through and past the longitudinal opening (24) and on the side, facing the other housing limb (26), bears the guide means (41).

15 Claims, 3 Drawing Sheets

LINEAR DRIVE MECHANISM WITHOUT A PISTON ROD

The invention relates to a piston rod-less (herein referred to as a rod-less) linear drive comprising a housing, which delimits a interior space extending in the longitudinal direction, in which a drive part is arranged for longitudinal movement and which has a slot-like longitudinal opening directed into the said housing interior space, such opening being flanked in the longitudinal direction on either side by a housing limb which is constituted respectively by a portion of the housing, an entraining part being arranged on the drive part, such entraining part extending outward through the longitudinal opening, such entraining part being kinematically coupled with a slide outside the housing, such slide being guided by means of a guide means for movement in the longitudinal direction in relation to the housing and being supported in the transverse direction.

Such a rod-less linear drive is for example disclosed in the European patent publication 0 540 015 B1. In the case of this drive the guide means arranged on the outer side of the housing limb, which is to the top in the preferred position of use of the linear drive, such limb being straddled by the slide cooperating with the guide means. On the top side of the section, which straddles the housing limb, of the slide a carrying face is provided which serves for the attachment of the load to be conveyed. In order to reduce the effect, due to the force of the weight of the load to be conveyed, on the housing the slide is additionally supported by a wheel running on a support face arranged on the other housing limb. Despite this supporting action there is however still the danger of slight deformation of the housing limb having the guide means in the case of extremely heavy loads to be conveyed, something which leads to a reduction in the width of the longitudinal opening and hence which may cause the development of wear promoting friction between the flanks of the longitudinal opening and the entraining part. The deformation furthermore impairs the accuracy of alignment of the slide, which may then run slightly skew. The same disadvantageous effective will occur, if the housing expands owing to internal pressure, in which case it may even happen that the slide lifts clear of the additional support face.

Therefore it is one object of the present invention to provide a rod-less linear drive, which, independently of the load to be conveyed, runs extremely accurately with little wear while at the same time having a compact structure.

In order to achieve this object in the invention one of the two housing limbs is extended in the depth direction of the longitudinal opening past same and on the side facing the other housing limb, of its extension section bears the guide means with the slide, this other housing limb being uncoupled from the slide as regards loads.

In the device of the invention independently of the size of the load to be conveyed by the slide deformation of the interior space in the housing and of the longitudinal opening is prevented. At the same time there is always an extremely high accuracy of guiding as regards the slide to be moved. If the linear drive is operated in its preferred position of use, wherein the side bearing the guide means faces upward, all forces necessary for guiding and support are taken up by the extended housing limb. The other shorter housing limb is decoupled from the slide and consequently is not acted upon by the load to be conveyed. Accordingly there is no possibility of constriction of the longitudinal opening due to the weight force of the load to be conveyed and accordingly no wear resulting from this. Moreover the accuracy of guiding will not suffer because of a splaying out, caused by a high internal pressure, of the housing, since the housing limb, decoupled from the slide, may deform without acting on the guide means or the slide.

Although the European patent publication 0 711 928 A2 discloses a rod-less linear drive, in the case of which the guide means is so arranged on the one housing limb that it is placed in the preferred position of use adjacent to the interior space of the housing and the danger of deformation of the housing is banished, this is only possible at the sacrifice of having the guide means arranged with a transverse clearance laterally adjacent to the longitudinal opening and of the having to have the slide fitting over the housing part with the interior space in the housing so that as measured in the depth direction of the longitudinal opening there is a i substantial overall height. On the other hand the configuration of the invention renders possible an arrangement, in the case of which the housing part having the interior housing space and the slide are placed alongside one another with only a small overall height, since because of the entraining part and owing to the alignment, facing the guide means, of the longitudinal opening there is a direct connection by the drive part and the slide.

Further advantageous developments of the invention are defined in the dependent claims.

It is convenient for the slide to be arranged in a receiving region of the housing, which in the depth direction of the longitudinal opening adjoins the longitudinal opening and at one side is delimited by the extension section. It is in this manner that it is possible to have particularly small dimensions in the height direction.

It is an advantage if on the side opposite to the extension section the slide bears a carrying face serving for the attachment of a load to be moved, and generally aligned parallel to the extension section, such carrying face being adjacent to the short housing limb. More particularly the carrying face can be arranged at the same level as the outer face of the short housing limb in order to provide a particularly low overall arrangement. In this respect there may be a provision such that the above mentioned outer face is slightly exceeded in level by the carrying face in order to ensure that a load with a large surface area arranged on the carrying face can extend past the carrying face in the transverse direction without then being obstructed by the housing.

It is furthermore convenient for the guide means to comprise a guide rail extending in the longitudinal direction of the housing and provided on the extension section, and furthermore a guide body provided on the slide, the guide body being mounted on the guide rail for motion in the longitudinal direction thereof while at the same time being supported in the transverse direction. Owing to the guide means, which can be produced without any great expense, a satisfactory guiding action in the longitudinal direction is ensured, which simultaneously is able to withstand the transverse forces occurring.

Because an anti-friction bearing arrangement is placed between the guide body and the guide rail, for instance in the form of a recirculating ball slide, it is possible for the frictional forces between the guide body and the guide rail to be substantially reduced so that even in the case of heavy loads it is possible to ensure free running properties of the guide body along the guide rail.

In a further convenient embodiment the drive part is constituted by a fluid operated piston, a flexible sealing tape being provided effectively adjacent to the inner side of the longitudinal opening in order to seal off such opening. Such so-called slotted cylinders are in practice highly satisfactory for linear drives, particularly when high accelerations of the slide are required.

In the following a working embodiment of the invention will be described with reference to the drawings in more detail.

Figure 1:
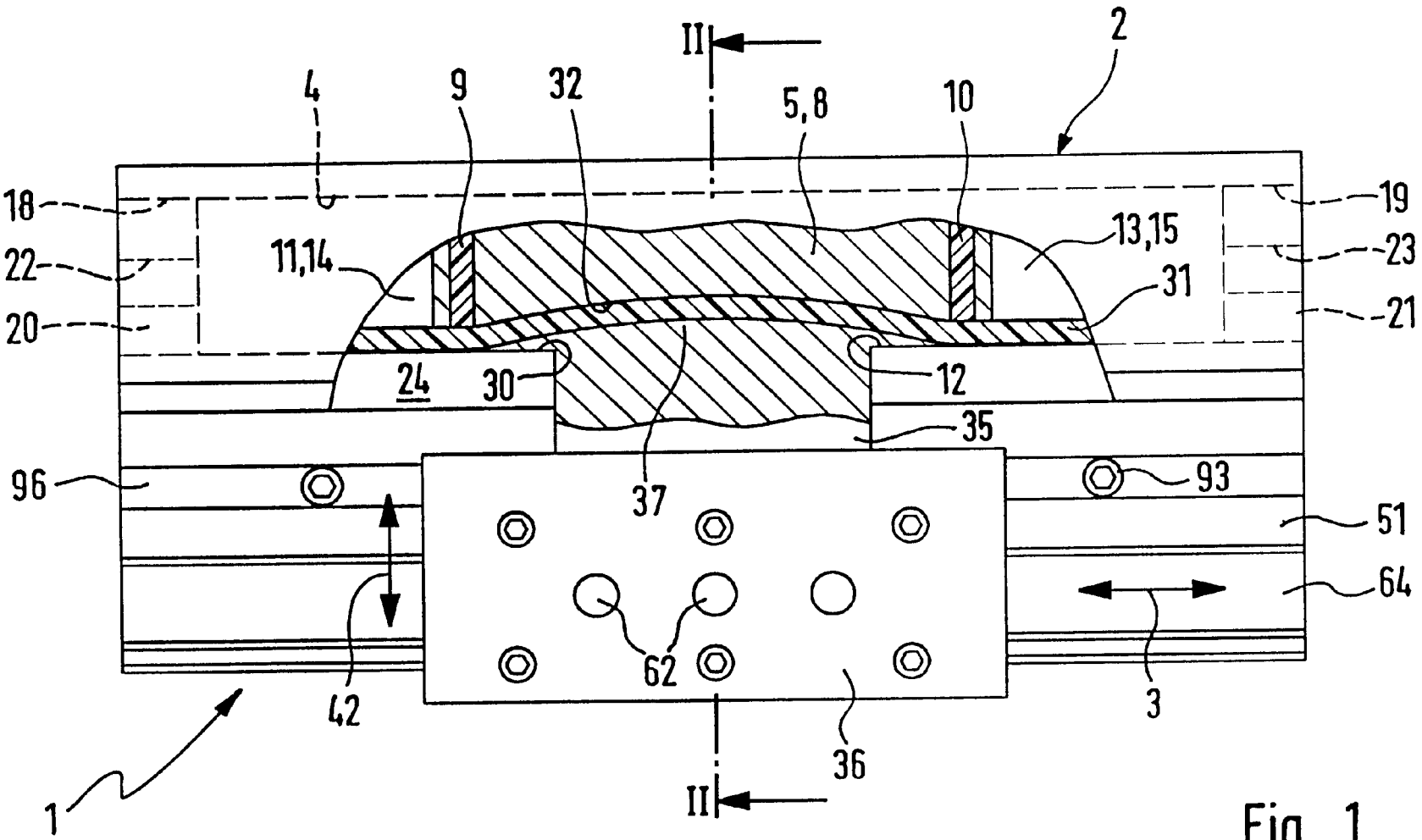
FIG. 1 shows a working embodiment of the linear drive of the invention in a partly cut away plan view looking in the direction of the arrow I in FIG. 2.

In the drawing the reader will see a rod-less linear drive 1, which possesses a housing 2, which delimits an interior space 4 extending in the longitudinal direction 3 of the housing 2, in which space a drive part 5 is arranged for longitudinal motion.

In principle it is possible to cause the drive part 5 to move in the longitudinal direction 3 by fluid or electrical power. In the example the drive part 5 is constituted by a fluid and more particularly pneumatically powered piston 8, which possesses two sealing arrangements 9 and 10 spaced apart in the longitudinal direction 3 and divides the interior space of the housing into three longitudinal sections 11, 12 and 13. The longitudinal section 12 placed between the two sealing arrangements 9 and 10 is always free of pressure, whereas the working spaces 14 and 15 constituted by the longitudinal sections 11 and 13 are designed to be pressure-tight. For this purpose the interior space 4 of the housing is sealed off at its two axial end regions 18 and 19 by a respective inserted terminal cover 20 and 21. For fluid operation of i the piston 8 fluid connections 22 and 23 opening into the working spaces 14 and 15 are provided, which in the working embodiment are in the terminal covers 20 and 21. The piston 8 and the interior space 4 of the housing have a circular cross section in the example.

The housing 2 has a slot-like longitudinal opening 24 directed on the one hand into the interior space 4 of the housing and on the on the other hand into the surroundings, such opening being flanked in the longitudinal direction 3 on either side by a respective housing limb 25 and 26 which is formed by a region of the housing 2.

For sealing off the longitudinal opening 24 a flexible sealing tape 31 is provided at the inner side 30 of the longitudinal opening 24, such tape sealing off the interior space 4 of the housing at its two working spaces 14 and 15 from the surroundings of the housing 2. For this purpose the sealing tape 31 may possess a trapezoidal cross section so that it makes sealing contact in the portion, tapering toward longitudinal opening 24, of the inner side 30 of the longitudinal opening 24. Between the two working spaces 14 and 15 adjacent to longitudinal section 12 of the interior space 4 of the housing the sealing tape 31 is threaded through a channel-like opening 32 extending through the piston 8 so that the sealing tape is spaced from the inner side 30 of the longitudinal opening 24 between the two sealing arrangements 9 and 10 of the piston 8.

It is in this manner that it is possible to arrange an entraining part 35 on the drive part 5 constituted by the piston 8 adjacent to the through opening 32, such entraining part 35 extending through the longitudinal opening 24 outward, being secured within the interior space 4 of the housing on the drive part 5 and being coupled kinematically outside the housing 2 with a slide 36. Between the inner side 30 of the longitudinal opening 24 and the through opening 32 the piston 8 possesses a connection portion 37, with which the entraining part 5 is connected. In the example the entraining part 35 and the drive part 5 constituted by the piston 8 are manufactured integrally.

To provide an axial kinematic coupling with the slide 36 the entraining part 35 is fixedly connected to the same. In the working embodiment the entraining part 35 is fashioned in the form of a rib, the end portion 38 associated with the slide 36 being made wider and secured to a head piece 39 provided on the slide 36.

By means of a guide means 41 the slide 36 is guided for movement relative to the housing 2 in the longitudinal direction 3 and it is supported in the transverse direction 42. Accordingly the slide 36 may be moved in relation to the housing 2 in the longitudinal direction 3, but however the guide means 41 takes up forces acting in the transverse direction 42 on the slide 36 so that the slide 36 is not able to be moved in the transverse direction 42 in the absence of any slight play present in the bearing.

One of the housing limbs 26 is extended in the depth direction 45 of the longitudinal opening 24 by an extension section 46 past the longitudinal opening 24 and in the following will be referred to as the extended housing limb 26. On the one side 47, which faces the other, short housing limb 25, the extension section 46 bears the guide means 41 with the slide 36. The extended housing limb 26 is accordingly composed of a base section 48, placed opposite to the short housing limb 25 and the extending section 46 adjoining the base section 48 in the depth direction of the longitudinal direction 24. The extending section 46 generally possesses a tabular configuration.

Accordingly the housing comprises a first housing part 27 which in cross section is generally U-like and contains the inner housing space 4 and the longitudinal opening 24, such housing part 27 being made up of the short housing limb 25 and the base section 48 of the extended housing limb 26, and furthermore a second housing part 28 constituted by the extending section 46.

Owing to the design of the extended housing limb 26 a receiving portion 51 is formed in the housing 2 to accommodate the slide 36, which in the depth direction 45 of the longitudinal opening 24 adjoins the latter and the short housing limb 25 is delimited at one side by the extending section 46. The receiving portion 51 is accordingly arranged adjacent to both the side 47, facing the short limb 25, of the extending section 46 and also to the free end, on the longitudinal side, of the short housing limb 25.

The short housing limb 25 is uncoupled as regards loads from the slide 36, which is guided and held on the extending section 46. The slide 35 is not supported on the short housing limb 25, but is spaced from the same so that it is impossible for any deforming forces to be transmitted to the short housing limb 25 or for any deformation of the short housing limb 25 to impair the accuracy of guiding of the slide 36.

On the slide 36 arranged in the receiving region 51 a carrying face 55 is provided, which is essentially parallel to the extending section 46, is on the side 54 opposite to the extending section 46 and is adapted to serve for the attachment of a load, (not illustrated in detail). Such carrying face is adjacent to the short housing limb 25 in the depth direction 55. The carrying face 55 of the slide 36 delimits the receiving space 51 practically on the side opposite to the extending section 46. The carrying face 55 may be arranged at the same height as the outer face 56 of the short housing limb 25 or deeper down and within the receiving region. Preferably the carrying face 55 extends past the outer face 56 however to a small extent in the height direction 52 of the linear drive 1 so that loads arranged on the carrying face 55 and projecting past same laterally, do not foul the short housing limb 25. This in turn serves to prevent external forces from acting on the short housing limb 25.

For the present the height direction 52 will be taken to be the direction at a right angle to the depth direction 42 and to the longitudinal direction 3. In a preferred position of use the linear drive is so arranged that the height direction extends vertically and both the inner side 47 of the extension section 46 and also the carrying face 55 and the outer face 56 of the short housing limb 25 are facing vertically upward. The entire weight force of a load secured to the carrying face 55 acts in this case on the extension section 46, which may be secured to a base body 92 which will be explained in more detail below.

In the working embodiment the slide 36 possesses a further, second carrying face 58. The same is arranged on a housing limb 60 extending toward the extension section 46, and provided on a longitudinal side 59, which is opposite to the short housing 25 and, respectively, the first housing part 27, such limb 60 extending toward the extension section 46. Said second carrying face is aligned essentially at a right angle to the first carrying face 55. Threaded holes 62 or other attachment means are provided on the carrying faces 55 and 58 to serve for the attachment of a load.

The slide limb 60, which in the present embodiment is tabular, extends on the side, which is opposite to the first housing part 27 in the depth direction 45, in front of the free end portion 61, extending in the longitudinal direction, of the extension section 46. The slide limb 60 accordingly delimits the receiving region 51 on the side opposite to the short housing limb 25.

The guide and means 41 is in the embodiment placed between the extension section 46 and the slide 36. It possesses a guide rail 64 running in the longitudinal direction 3 of the housing 2 and arranged on the extension section 46. In the working example in accordance with FIGS. 1 and 2 guide rail 64 is designed to be separate from the extension section 46 and secured to same with the aid of suitable attachment measures. For this purpose it is possible to provide a groove-like attachment recess 65 which runs in the longitudinal direction 3 and extends in the end portion 61 from the side 47 facing the short housing limb 25, the groove flank 67 thereof opposite to the outer free end 66 of the extension section 46 running with a taper toward the open side of the attachment recess 65. The outer groove flank 68, which is associated with the free end 66 of the extension section 46 is formed by a face, which delimits the attachment recess 65 laterally in the longitudinal direction 3, of an outer wall section 69, which extends in the longitudinal direction 3. Prior to attachment of the guide rail 64 on the extension section 46 this wall section is aligned generally at a right angle to the groove floor 70 of the groove-like attachment recess 65.

In its section associated with the extension section 46 the guide rail 64 possesses an attachment portion 73 with a trapezoidal cross section. After the insertion of the guide rail 64 in the attachment recess 65 the attachment portion 73 fits at least partially into this attachment recess 65, the longitudinal side 74, facing the inner groove flank 67, of the attachment portion engaging this inner groove flank 67 over a large surface area. The wall section 69 of the extension section 46 is then, for example by rolling, so plastically deformed that the outer groove flank 68 as well makes engagement over a large surface area with the longitudinal side 75, associated with it, of the attachment portion 73 of the guide rail 64. It is in this manner that the guide rail 64 is connected without screws firmly with the extension section 46 of the extended housing limb 26.

The guide means 41 comprises furthermore a guide body 79 provided on the lower side, facing the extension section 46, of the slide 36, which body is supported in the transverse direction 42 in a movable manner on the guide rail 64 for translatory movement in the longitudinal direction 3 thereof. The guide body 79 is essentially U-like in shape and possesses a longitudinal groove 80 extending through it in the longitudinal direction, into which groove a guide portion 78 of the guide rail 64 at least partially fits, said guide portion 78 adjoining the attachment portion 73 and extending away from the extension section 46. On the side 81, opposite to the longitudinal groove 80, the guide body 79 is detachably connected with the slide 36. In the present example screw connecting means 82 are provided for this purpose. Preferably, the guide body 79 has the same longitudinal extent in the longitudinal direction 3 as the slide 36 fixed on it.

Between the guide body 79 and the guide rail 64 an anti-friction bearing arrangement 86 is placed which for instance is in the form of a recirculating ball slide 85. It is in this manner that a low friction and accordingly a precise guide system is provided between the guide body 79 and the guide rail 64. In the working embodiment the anti-friction bearing arrangement 86 is placed between the flanks 87 of the longitudinal groove 80 and the respectively adjacent longitudinal side 88 of the guide portion 78. In the case of the a recirculating ball slide 85 employed here the balls 89 thereof move along ring-like circuits, there always being a plurality of balls 89 between the groove flanks 87 and groove-like recesses 95 provided on the respectively associated longitudinal side 88 of the guide portion 78.

Instead of an anti-friction bearing between the guide body 79 and the guide rail 64 it would be feasible as well to have a plain bearing means.

In the working embodiment the slide 36 straddles the guide means 41, the latter being flanked on the one longitudinal side by the slide limb 60 and on the other longitudinal side by the head piece connected with the entraining part 35.

For the installation of the linear drive 1 in a larger system, not illustrated, it is possible for the side 90, which is opposite to the guide means 41, of the extended housing limb 26 to form an attachment side 91, by means of which the housing 2 may be mounted on a base 92 serving for holding.

In the working embodiment the extension section 46 is provided on the inner side 47, which faces the slide 36, with at least one longitudinally extending groove 96, which is open toward the attachment side 91 through a plurality of apertures 97 spaced out along its length, attachment screws 93 being able to be inserted through the apertures 97 to be screwed into threaded holes in the base 92 in order to brace the housing 2 at the outer face of the extended housing limb 26 firmly against the base 92.

The linear drive has extremely compact dimensions in the above mentioned height direction 52 and its is very low in form. The first housing part 27 and the slide 36 are alongside each other in the transverse direction 42, which coincides with the depth direction 45 of the longitudinal opening 24, and are essentially at the same level. Since the longitudinal opening 24 is so arranged that its depth direction 45 coincides with the transverse direction 42 of the housing 2, the outer opening 98, which is radially to the outside as related to the housing's interior space 4, of the longitudinal opening 24 faces the receiving region 51 so that an extremely short and direct entraining connection may be produced between the drive part 5 and the slide 36, which extends essentially in the transverse direction 42. It is hence unnecessary to guide the entraining member in the height direction 52 past the first housing part 27 to the slide, something which would mean a substantial increase in the size of the height dimensions.

Furthermore it is possible to ensure that the load secured to the slide 36 only acts on the extension section 46 via the guide means 41, such extension section 46 for its part being attached to the base 92 so that the entire inertial forces are transmitted to such base 92 and do not act on the shorter housing limb 25. The latter is consequently decoupled from the slide as regards loads so that there is at all times sufficient width of the longitudinal opening 24 ensuring trouble-free longitudinal motion of the entraining member 35.

If owing to the heavy pressure effect necessary in the working spaces 14 and 15 the first housing part 27 should tend to splay outward at the longitudinal opening 24, this will not cause any undesired effect on the accuracy of guiding and positioning by the slide 36. The short housing limb 25 may deform unhindered by the extended housing limb 26 secured to the base 92 or by the guide means 41 mounted on the latter. The entire guiding and transverse support of the slide 36 in all transverse directions is by means of the extended housing limb 26 so that it is possible to do without further support measures between the slide 36 and the first housing part 27.

Figure 2:
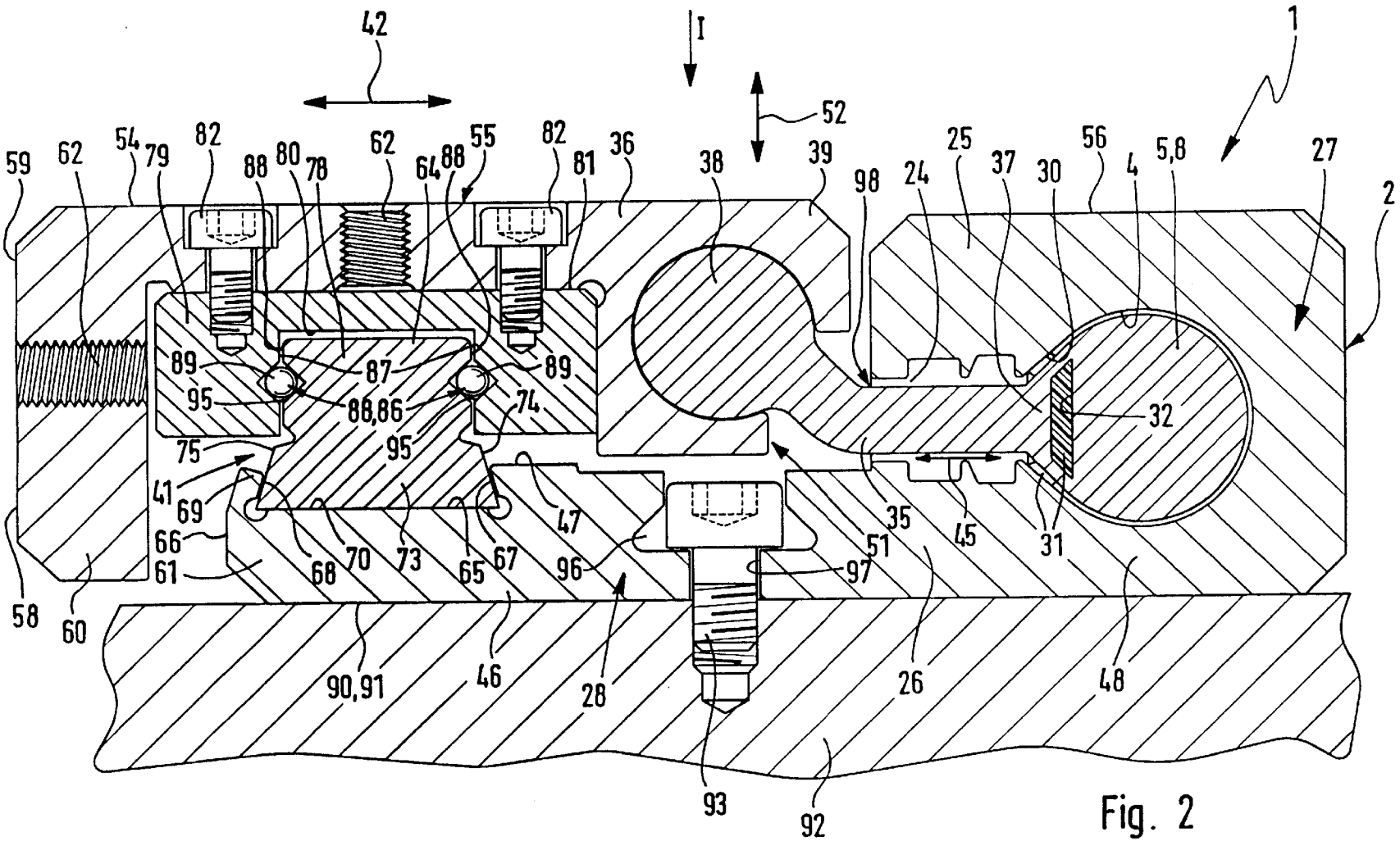
FIG. 2 shows the embodiment of the linear drive in accordance with FIG. 1 in a cross section taken on the section line II—II of FIG. 1.
Figure 3:
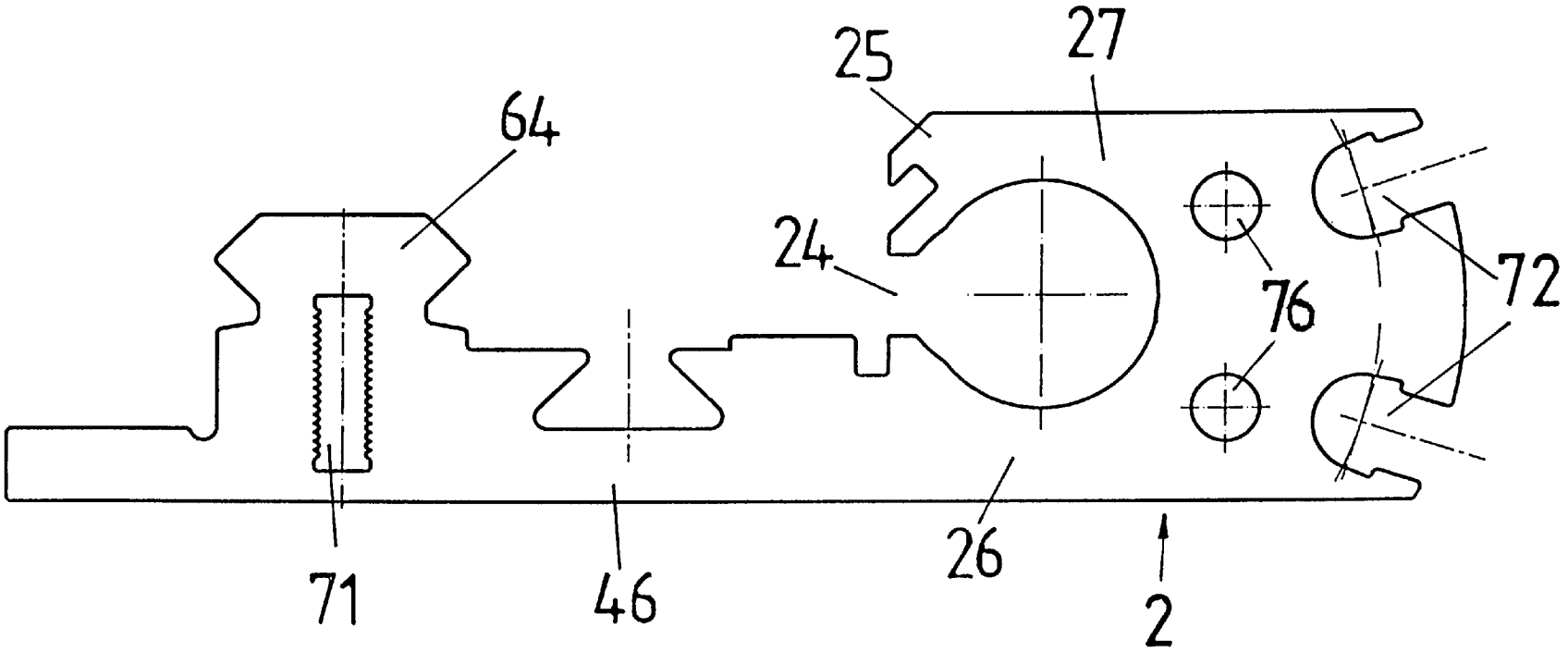
FIG. 3 shows the housing of a further working embodiment of the linear drive in an end-on view.

FIG. 3 shows a further possible design of the housing 2 of the linear drive. Parts the same as previously described parts are in this case provided with identical reference numerals. A significant departure from the embodiment of FIGS. 1 and 2 is that the guide rail 64 is made integrally with the extension section 46. This opens up the advantageous possibility of manufacturing the housing 2 including the guide rail 64 jointly in one single working step by extrusion. In this case the integrally molded-on guide rail 64 is more particularly suitable for producing a plain or sliding guide, something which renders possible a further reduction in costs as compared with the anti-friction bearing guide illustrated in FIGS. 1 and 2.

It is also possible if required to integrate a screw channel 71 in the guide rail 64, such channel being closed peripherally and extending in the longitudinal direction of the guide rail 64. On opposite wall faces it has longitudinally extending teeth. If the screw channel 71 is drilled into on one narrow side a screw serving for example for attachment may be screwed into it, the oppositely placed teeth assuming the function of a screw thread.

FIG. 3 furthermore indicates that on the outer face of, more particularly, the U-like first housing part 27, the housing 2 may be provided with one or more longitudinal grooves 72 serving for anchoring additional parts. As an example sensors could be arranged therein which serve to ascertain the position of the drive part 5. In the working embodiment two longitudinal grooves 72 are arranged on the rear side, opposite to the longitudinal opening 24, of the first housing part 27, the outer face being convexly curved and the longitudinal grooves 72 being arranged on an arcuate line.

FIG. 3 furthermore shows two channels 76 extending through the first housing part 27 in the longitudinal direction, such channels preferably being employed for the pressure medium utilized for operating the drive part 5.

What is claimed is:

1. A piston rod-less linear drive comprising:

a housing (2), which delimits a interior space (4) extending in the longitudinal direction (3), in which a drive part (5) is arranged for longitudinal movement and which has a slotted opening (24) directed into said housing interior space (4), said slotted opening being flanked in the longitudinal direction (3) on either side by a housing limb (25 and 26), which is constituted respectively by a portion of the housing (2), an entraining part (35) being arranged on the drive part (5), such entraining part extending outward through the slotted opening, and a slide (36) having a top surface forming a first load carrying surface and a slide limb positioned substantially perpendicular to said top surface, said slide limb extending downward past an extension section of the housing limb to form a second load carrying surface, said slide being kinematically coupled to said entraining part outside the housing (2), said slide being guided by a guide means (41) for movement in the longitudinal direction (3) in relation to the housing and being supported in the transverse direction (42), wherein one of the two housing limbs (26) is extended laterally past the longitudinal opening (24) forming an extension section (46) that bears the guide means (41) with the slide (36), and the other housing limb (26) is uncoupled from the slide as regards loads.

2. The linear drive as claimed in claim 1, characterized in that the slide (36) is arranged in a receiving region (51) of the housing (2), which in the depth direction (45) of the longitudinal opening (24) adjoins the longitudinal opening (24) and at one side is delimited by the extension section (46).

3. The linear drive as claimed in claim 1, characterized in that on the side (54) opposite to the extension section (46) the slide (36) bears a carrying face (55) serving for the attachment of a load to be moved, and generally aligned parallel to the extension section (46), such carrying face being adjacent to the other housing limb (25).

4. The linear drive as claimed in claim 3, the carrying face (55) is arranged approximately at the same level as the outer face (56) of the short housing limb (25) and preferably extends slightly past same.

5. The linear drive as claimed in claim 1, characterized in that the drive part (5) is constituted by a fluid operated piston (8), in which respect for sealing the longitudinal opening (8) a flexible sealing tape (31) is provided adjacent to the inner side thereof.

6. The linear drive as claimed in claim 1, characterized in that the side (90) which is opposite to the guide means (41), of the extended housing limb (26) constitutes an attachment side (91), at which the housing (2) is selectively mounted on a base (92) serving for holding.

7. The linear drive as claimed in claim 1, characterized in that the guide means (41) possesses a guide rail (64) extending in the longitudinal direction (3) of the housing (2) and arranged on the extension section (46).

8. The linear drive as claimed in claim 7, characterized in that the guide means (41) possesses a guide body (79) provided on the slide (36), such guide body being guided for sliding motion on the guide rail (64) and being at the same time supported in the transverse direction (42).

9. The linear drive as claimed in claim 8, characterized in that between the guide body (79) and the guide rail (64) an anti-friction bearing arrangement (86) is arranged in the form of a recirculating ball slide (85).

10. The linear drive as claimed in claim 8, characterized in that the guide body (79) possesses a longitudinal groove (80) extending through it in the longitudinal direction (3) and into which the guide rail (64) at least partially fits.

11. The linear drive as claimed in claim 8, characterized in that the slide (36) straddles the guide body (79) and the guide rail (64).

12. The linear drive as claimed in claim 7, characterized in that the guide rail (64) is designed in the form of a separate component fixed to the extension section (46) by attachment means.

13. The linear drive as claimed in claim 7, characterized in that the guide rail (64) and the extension section (46) are manufactured integrally with each other.

14. The linear drive as claimed in claim 1, characterized in that the guide means (41) is designed in the form of an anti-friction bearing or plain bearing means.

15. A piston rod-less linear drive comprising:

a housing (2), which delimits a interior space (4) extending in the longitudinal direction (3), in which a drive part (5) is arranged for longitudinal movement and which has a slot-like opening (24) directed into said housing interior space (4), slot-like opening being flanked in the longitudinal direction (3) on either side by a housing limb (25 and 26), which is constituted respectively by a portion of the housing (2), an entraining part (35) being arranged on the drive part (5), such entraining part extending outward through the slot-like opening; and a slide (36) kinematically coupled to said entraining part outside the housing (2), said slide being guided by a guide means (41) for movement in the longitudinal direction (3) in relation to the housing and being supported in the transverse direction (42), wherein one of the two housing limbs (26) is extended laterally past the slot-like opening (24) forming an extension section (46), wherein said extension section (46) is integrally extruded with the guide means, and said extension section (46) bears the guide means (41) with the slide (36), and the other housing limb (26) is uncoupled from the slide as regards loads.

* * * * *

UNITED STATES PATENT AND TRADEMARK OFFICE

CERTIFICATE OF CORRECTION

PATENT NO. : 6,186,049 B1
DATED : February 13, 2001
INVENTOR(S) : Kurt Stoll, Eric Angue It is certified that error appears in the above-identified patent and that said Letters Patent is hereby corrected as shown below:

Column 8,
Line 19, now reads "forming an extension" should read -- forming said extension --
Lines 36 and 37, now reads "and preferably extends" should read -- and extends --

Signed and Sealed this

Twelfth Day of March, 2002

*Attest:*

*Attesting Officer*

JAMES E. ROGAN
*Director of the United States Patent and Trademark Office*